US005409044A

United States Patent [19]

Lin

[11] Patent Number: 5,409,044

[45] Date of Patent: Apr. 25, 1995

[54] CIRCULAR LOOM HAVING IMPROVED SHUTTLE RETENTION

[76] Inventor: Yao-Chang Lin, NO.28, Shih-Chia Lane, Shih-Chia Li, 401 Tung Dist., Taichung City, Taiwan, Prov. of China

[21] Appl. No.: 201,900

[22] Filed: Feb. 25, 1994

[51] Int. Cl.[6] ..... D03D 37/00

[52] U.S. Cl. ..... 139/457

[58] Field of Search ..... 139/457, 459

[56] References Cited

U.S. PATENT DOCUMENTS

| | | | |
|---|---|---|---|
| 4,509,562 | 4/1985 | Schonberger et al. | 139/457 |
| 4,821,778 | 4/1989 | Zacek | 139/457 |
| 5,056,567 | 10/1991 | Kitazawa | 139/457 |

FOREIGN PATENT DOCUMENTS

| | | | |
|---|---|---|---|
| 2123857 | 2/1984 | United Kingdom | 139/459 |

*Primary Examiner*—Andrew M. Falik

*Attorney, Agent, or Firm*—Harness, Dickey & Pierce

[57] ABSTRACT

A circular loom includes an endless raceway assembly and a shuttle sliding along the raceway assembly. The raceway assembly includes an upper ring plate, a lower ring plate, and a rod mechanism interposed between the upper and lower ring plates. The rod mechanism includes a row of outer guide rod units interconnecting the upper and lower ring plates, and a row of inner guide rod units aligned respectively and radially with the outer guide rod units so as to define a confining space therebetween. Each of the inner guide rod units includes an upper inner rod section secured to the upper ring plate, and a lower inner rod section secured to the lower ring plate so as to define an accommodating space between the upper and lower inner rod sections. The shuttle includes a shuttle body, a horizontal guide plate extending outwardly from the shuttle body through the accommodating spaces of the inner guide rod units, a vertical guide plate secured to a radial outer end of the horizontal guide plate, and two sliding bodies connected respectively to upper and lower portions of the vertical guide plate. The sliding body has two vertical side walls slidable respectively on the inner and outer guide rod units. The upper ring plate has a removable portion which allows the shuttle to be put into the confining spaces.

7 Claims, 13 Drawing Sheets

CIRCULAR LOOM HAVING IMPROVED SHUTTLE RETENTION

BACKGROUND OF THE INVENTION

1. Field of the Invention

This invention relates to a circular loom, more particularly to a circular loom which has a rod mechanism positioned on an endless raceway assembly of the circular loom so as to prevent removal of shuttles of the circular loom from the raceway assembly.

2. Description of the Related Art

The improvement of this invention is directed to a conventional circular loom 1, as shown in FIGS. 1 and 2. The fundamental weave of the circular loom 1 is to be constituted by means of warp thread (S) and weft thread (N) intersections (see FIG. 4) so as to weave a cloth (see FIG. 2). Then, the cloth 2 passes over a cutting device 3 so as to be cut into the desired size. Finally, with the use of a connecting device 4, the cut cloth 2 is wound into a cylindrical product.

Referring to FIGS. 1 and 3, the weaving principle of the circular loom 1 resides in the application of several shuttles 5 (only one is shown) which slide along an endless raceway assembly 6 of the circular loom 1 so as to drive some weft threads (N). The raceway assembly 6 includes a stationary horizontal upper ring plate 61, a stationary horizontal lower ring plate 62 located under the upper ring plate 61, and a row of circumferentially aligned guide rods 63 interposed between the upper and lower ring plates 61, 62 and spaced apart from each other at a predetermined distance. The shuttle 5, as best shown in FIG. 4, includes a curved shuttle shell 51 disposed vertically between the upper and lower ring plates 61, 62 by means of several wheels 54 (only two can be seen) that are mounted on the upper and lower portions of the shuttle shell 51 and that press against the bottom and top walls of the upper and lower ring plates 61, 62. An elliptical shuttle frame 52 (see FIG. 3) is mounted securely on the inner surface of the shuttle shell 51. A guide bar 53 is secured to an end portion of the shuttle frame 52 (see FIG. 3) at an end thereof. A bobbin 531 is mounted securely on the distal end of the guide bar 53 so as to insert a weft thread (N) into a shed that is formed between the raised and lowered warp threads (S). Two sliding bodies 55 are connected threadably to the outer surface of the shuttle shell 51. Each of the sliding bodies 55 has an outer surface which slides on the guide rods 63.

Referring to FIGS. 3 and 5, the circular loom 1 further includes a rotatable timing disc 7, a power mechanism (not shown) installed in the circular loom 1 and capable of rotating the rotatable timing disc 7, a thrust unit 8 interconnecting the timing disc 7 and one of the end portions of the shuttle frame 52 so as to move the shuttle 5 synchronously with the rotation of the timing disc 7, and a stopper unit 9 interconnecting the timing disc 7 and the other end portion of the shuttle frame 52 and being capable of preventing the shuttle 5 from colliding with another shuttle on the raceway assembly 6.

The main drawbacks of the conventional circular loom 1 are as follows:

1. When the circular loom 1 is in use, the shuttle 5 moves on the raceway assembly 6 by the application of a push force (F) from the thrust unit 8 so that a centrifugal force (A) is produced on the shuttle 5, as shown in FIG. 6. At the same time, the weft thread (N) and the guide bar 53 respectively provide pull forces (B), (C) which are in a direction opposite to that of the centrifugal force (A). Because the resultant force of the pull forces (B), (C) is equal to the centrifugal force (A), the shuttle 5 can slide along the raceway assembly 6 to weave a cloth. However, when it is desired to manufacture a cloth of greater strength, the resultant force of the pull forces (B), (C) should be larger than the centrifugal force (A). Accordingly, the shuttle 5 may be pulled out of the raceway assembly 6. As a result, not only can the circular loom 1 not be operated continuously, but the shuttles 5 and the raceway assembly 6 are also damaged due to collision of the same.

2. When it is desired to manufacture a cloth of weaker strength, the warp thread (S) and the weft thread (N) are thinner. As a result, the warp threads (S) are cut off easily when the wheels 54 of the shuttle 5 press the warp threads (S).

SUMMARY OF THE INVENTION

The main objective of this invention is to provide a circular loom which has a rod mechanism positioned on an endless raceway assembly of the circular loom so as to prevent removal of the shuttle of the circular loom from the raceway assembly.

According to this invention, a circular loom includes an endless raceway assembly and a shuttle sliding along the raceway assembly. The raceway assembly includes a stationary horizontal upper ring plate, a stationary horizontal lower ring plate located under the upper ring plate, and a vertical rod mechanism interposed between the upper and lower ring plates. The rod mechanism includes a row of circumferentially aligned outer guide rod units spaced apart from each other at a first predetermined distance, and a row of circumferentially aligned inner guide rod units spaced apart from each other at a second predetermined distance and located inside the outer guide rod units. Each of the inner guide rod units is aligned radially with a corresponding one of the outer guide rod units so as to define a confining space between the inner guide rod unit and the corresponding one of the outer guide rod units. The inner and outer guide rod units are radially spaced apart from each other at a third predetermined distance. Each of the outer guide rod units has a generally vertical continuous outer rod section interconnecting securely the upper and lower ring plates. Each of the inner guide rod units includes at least one generally vertical continuous inner rod section positioned between the upper and lower ring plates, and an accommodating space positioned between the upper and lower ring plates and in line with the inner rod section. The shuttle includes a shuttle body, a horizontal guide plate secured to and extending radially outward from the shuttle body, a tangentially extending vertical guide plate connected securely to a radial outer end of the horizontal guide plate, and two sliding bodies respectively and removably connected to upper and lower portions of the vertical guide plate. The horizontal guide plate extends through the accommodating spaces of the inner guide rod units when the shuttle slides along the raceway assembly. The vertical guide plate is confined between the inner and outer guide units. The sliding body has two vertical side walls which respectively slide on the inner and outer guide rod units. One of the upper and lower ring plates has a removable portion which is connected removably to a remaining portion thereof and which is coupled with some of the inner guide rod units so as to put the vertical guide plate of the shuttle into some of the confining spaces during assembly of the shuttle and the raceway assembly.

BRIEF DESCRIPTION OF THE DRAWING

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
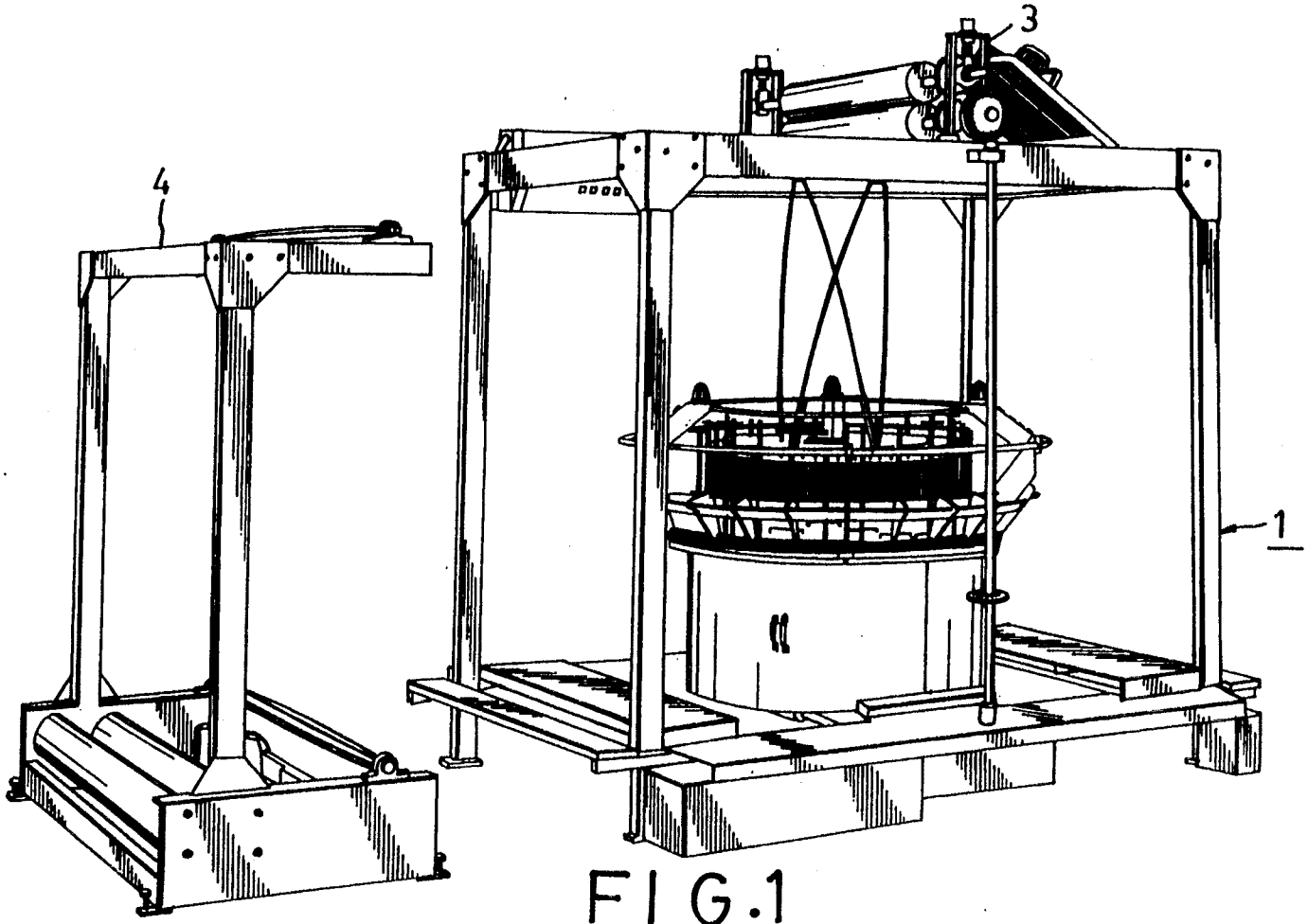
FIG. 1 PRIOR ART
FIG. 1 is a perspective view of a conventional circular loom.
Figure 2:
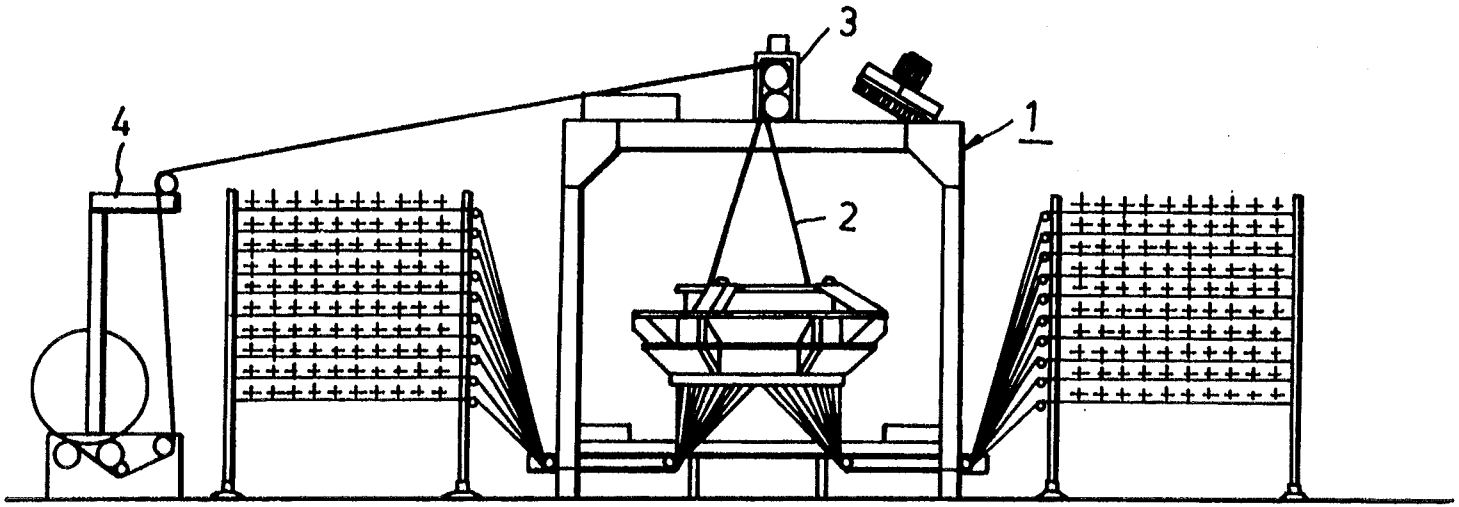
FIG. 2 PRIOR ART
FIG. 2 is a schematic view illustrating the operation of the conventional circular loom.
Figure 3:
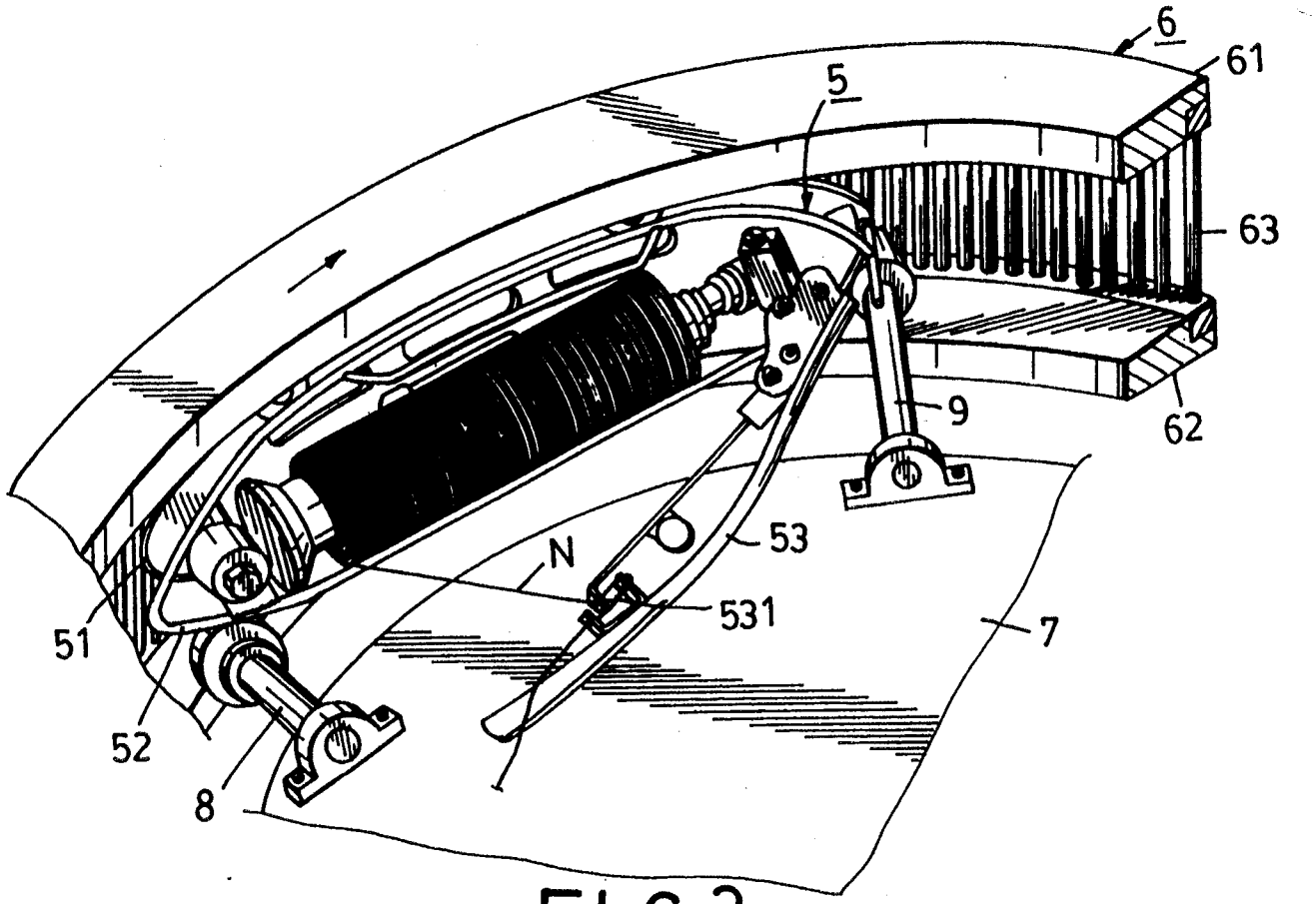
FIG.3 PRIOR ART
FIG. 3 is a perspective view showing a shuttle and a portion of an endless raceway assembly of the conventional circular loom.
Figure 4:
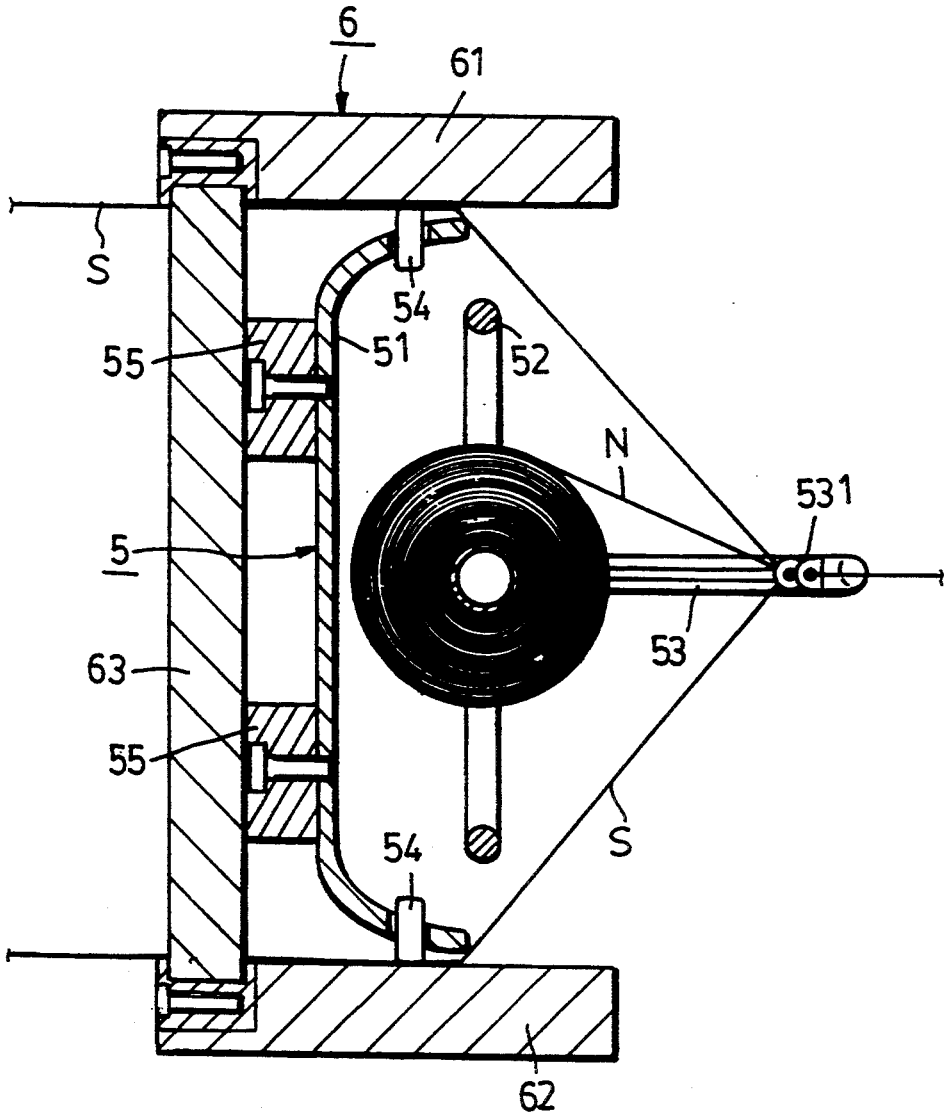
FIG.4 PRIOR ART
FIG. 4 is a sectional view showing an assembly of the raceway assembly and the shuttle of the conventional circular loom.
Figure 5:
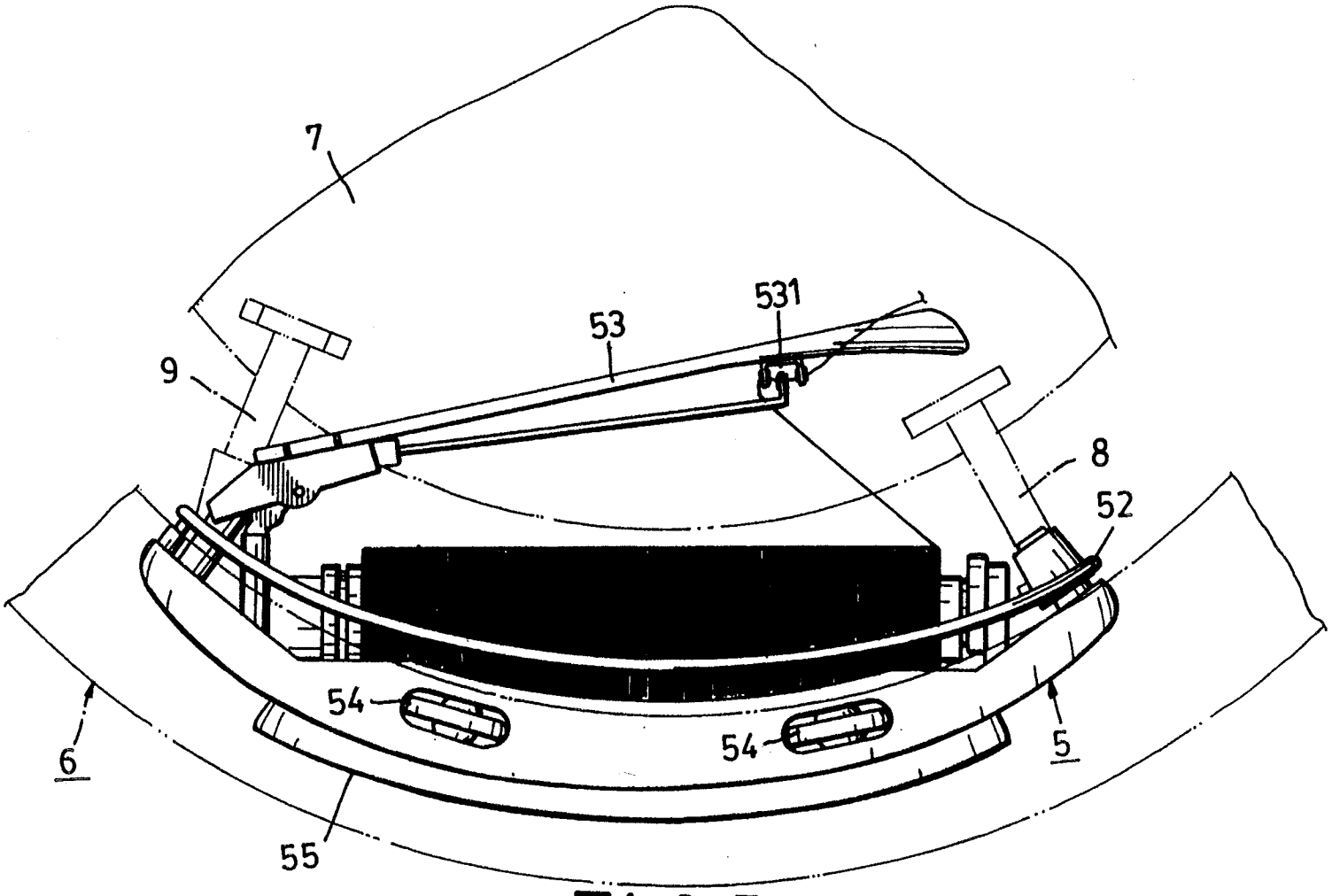
FIG. 5 PRIOR ART
FIG. 5 is a schematic view illustrating how the shuttle slides along the raceway assembly in a conventional loom.
Figure 6:
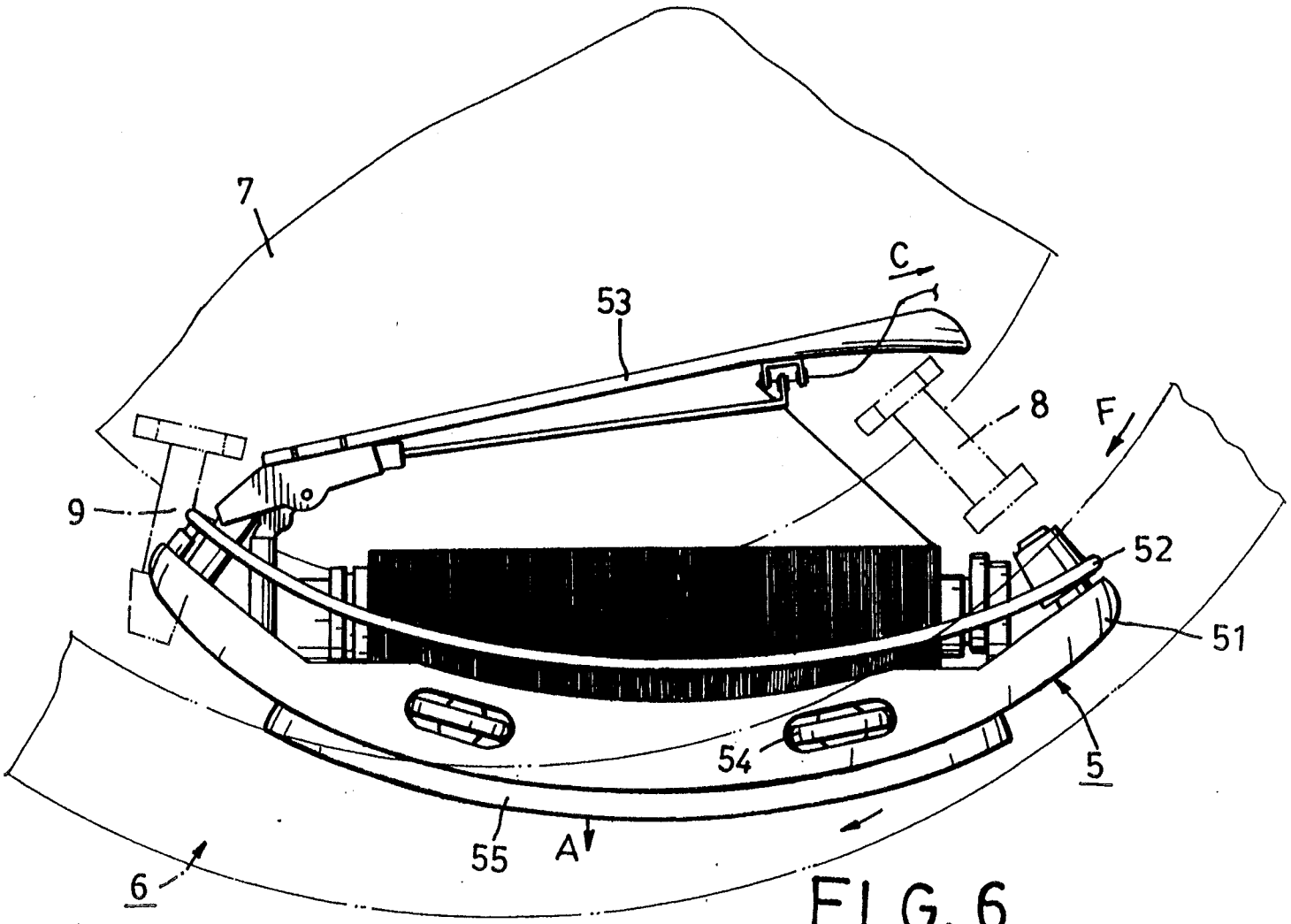
FIG. 6 PRIOR ART
FIG. 6 is a schematic view illustrating one of the drawbacks of the conventional circular loom when in use.
Figure 7:
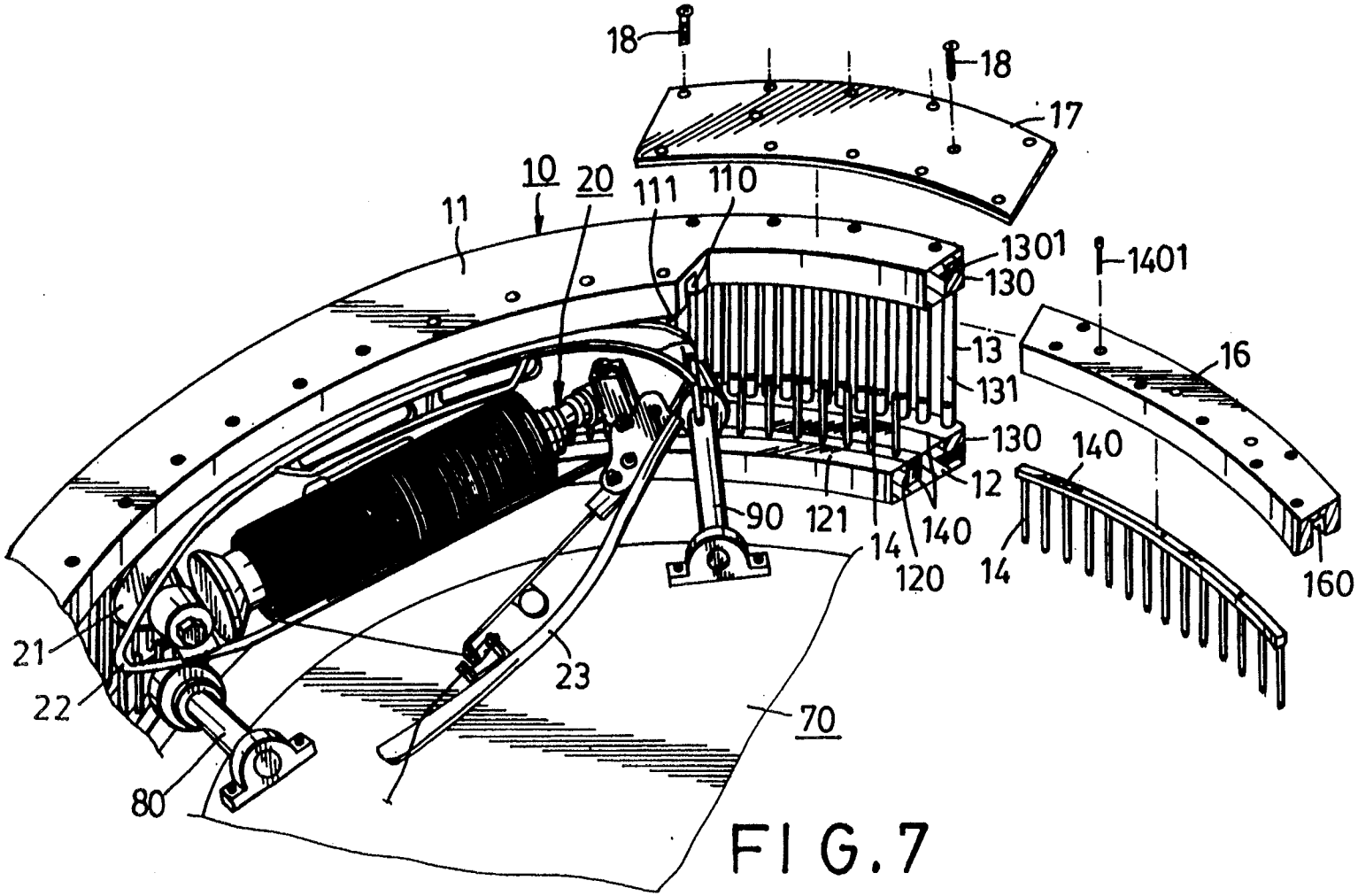
FIG. 7 is a partially exploded perspective view showing a shuttle and a portion of an endless raceway assembly of a circular loom in accordance with the invention.
Figure 8:
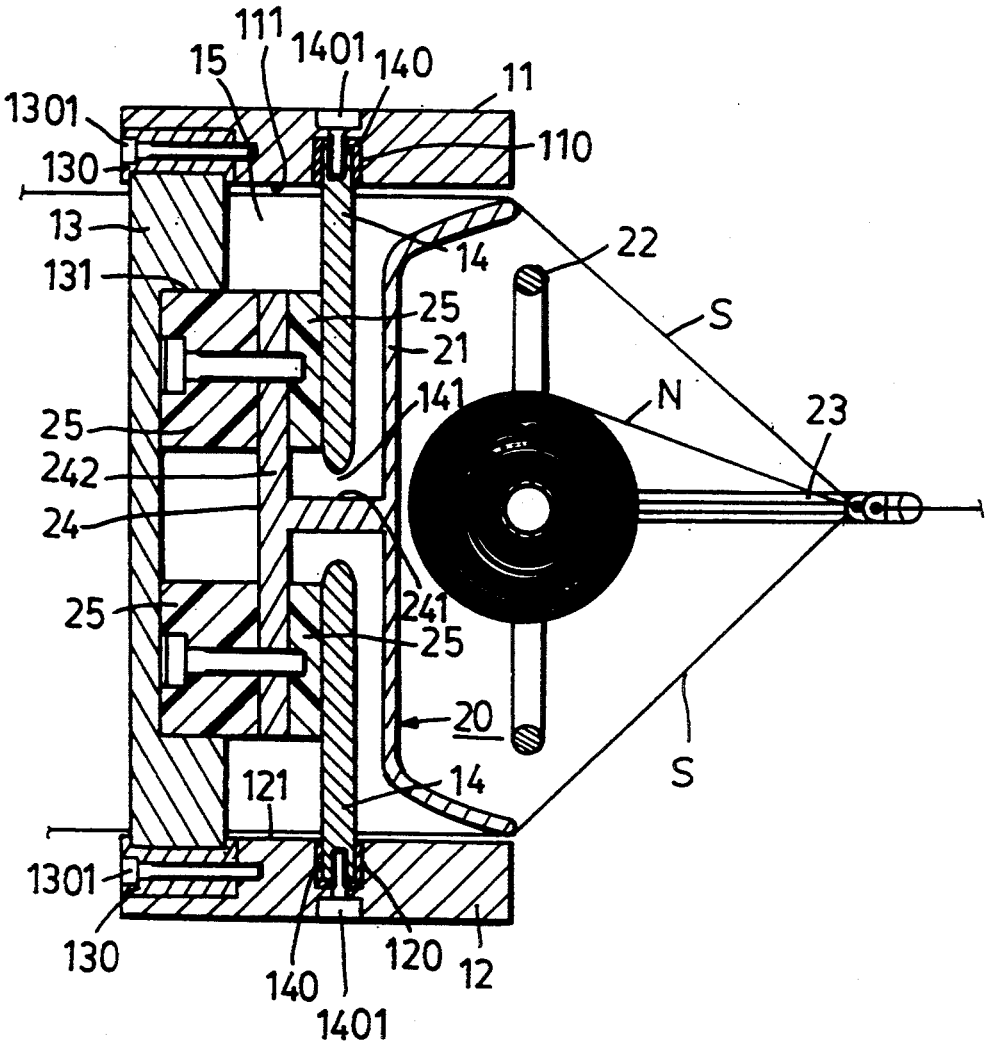
FIG. 8 is a sectional view showing an assembly of the raceway assembly and the shuttle of the circular loom according to the first embodiment of this invention.

Referring to FIGS. 7 and 8, a circular loom of the first embodiment of this invention includes an endless raceway assembly 10 and several shuttles 20 (only one is shown) which slide along the raceway assembly 10.

The raceway assembly 10 includes a stationary horizontal upper ring plate 11, a stationary horizontal lower ring plate 12, and a vertical rod mechanism interposed between the upper and lower ring plates 11, 12. The upper ring plate 11 has a notch 110 formed in the bottom surface 111 thereof. The lower ring plate 12 has a notch 120 formed in the top surface 121 thereof and aligned with the notch 110 of the upper ring plate 11.

The rod mechanism includes a row of circumferentially aligned outer guide rod units 13 spaced apart from each other at a first predetermined distance, a row of circumferentially aligned inner guide rod units 14 spaced apart from each other at a second predetermined distance and located inside the outer guide rod units 13, several horizontal outer curved blocks 130 which are connected threadably to the outer vertical walls of the upper and lower ring plates 11, 12 by means of several bolts 1301, and several horizontal inner curved blocks 140 which are mounted threadably in the notches 110, 120 of the upper and lower ring plates 11, 12 by means of several bolts 1401.

Each of the outer guide rod units 13 has a generally vertical continuous outer rod section which interconnects securely the outer curved blocks 130 at two end portions thereof, and a recess 131 that is formed in a surface of the outer rod section and that faces a corresponding one of the inner guide rod units 14.

Each of the inner guide rod units 14 is aligned radially with the corresponding one of the outer guide rod units 13 so as to define a confining space 15 between the inner guide rod unit 14 and the corresponding one of the outer guide rod units 13. The inner and outer guide rod units 14, 13 are radially spaced apart from each other at a third predetermined distance. Each of the inner guide rod units 14 has an upper inner rod section with an upper end that is secured to the inner curved blocks 140 at the upper ring plate 11, and a lower inner rod section with a lower end that is secured to the inner curved blocks 140 at the lower ring plate 12 so as to define an accommodating space 141 between the lower end of the upper inner rod section and the upper end of the lower inner rod section of the inner guide rod unit 14. The accommodating spaces 141 between the upper and lower inner rod sections are aligned with each other.

Figure 9:
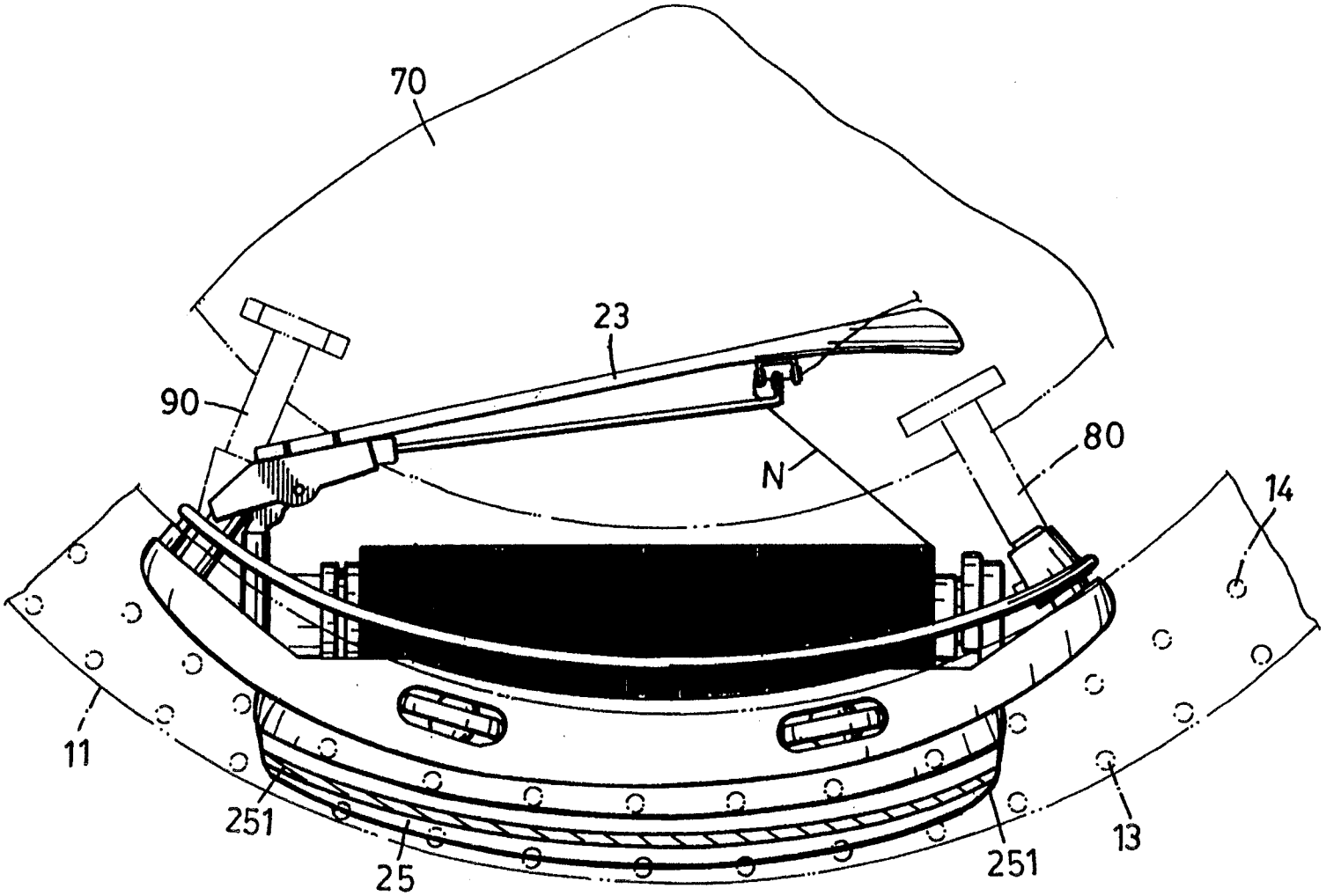
FIG. 9 is a schematic view illustrating the operation of the assembly of the raceway assembly and shuttle in accordance with the first embodiment of this invention.

The shuttle 20 has a shuttle body which includes a curved shuttle shell 21 that is disposed vertically between the upper and lower ring plates 11, 12, an elliptical shuttle frame 22 that is positioned inside the shuttle shell 21, and a guide bar 23 mounted securely on an end portion of the shuttle frame 22 at an end portion thereof. The shuttle body can move along the raceway assembly 10 by means of a timing disc 70, a thrust unit 80, and a stopper unit 90 which are similar in function to the conventional circular loom so as to weave a cloth in a known manner. The shuttle 20 further has a guide plate assembly 24 which includes a horizontal guide plate 241 secured to and extending radially outward from the shuttle shell 21 of the shuttle body, and a tangentially extending vertical guide plate 242 which has a middle portion that is connected securely to a radial outer end of the horizontal guide plate 241 and that is located between the upper and lower portions of the vertical guide plate 242, an upper end located at a level above the lower ends of the upper inner rod sections, and a lower end located at a level below the upper ends of the lower inner rod sections. Two sliding bodies 25 are respectively and removably connected to the upper and lower portions of the vertical guide plate 242 and are confined within the recesses 131 of the outer guide rod units 13. The horizontal guide plate 241 extends through the accommodating spaces 141 of the inner guide rod units 14 when the shuttle 20 slides along the raceway assembly 10. The vertical guide plate 242 is confined between the outer and inner guide rod units 13, 14. Each of the sliding bodies 25 has two vertical side walls which respectively slide on the rod sections of the outer and inner guide rod units 13, 14, and two curved surfaces 251, as shown in FIG. 9, formed in two end surface thereof so as to facilitate sliding of the sliding body 25 on the rod sections of the outer and inner guide rod units 13, 14.

Again referring to FIGS. 7 and 8, the upper ring plate 11 has a removable portion 16 which is connected removably to a remaining portion of the upper ring plate 11 by means of a connecting plate 17 which interconnects threadably the upper ring plate 11 and the removable portion 16 with the use of several bolts 18. The removable portion 16 has a notch 160 formed in the bottom surface thereof and aligned circumferentially with the notch 120 of the lower ring plate 12 so as to receive an inner curved block 140 and some of the inner guide rod units 14. When the removable portion 16 is removed from the upper ring plate 11, the vertical guide plate 242 of the shuttle 20 can be removed from the confining spaces 15 via a gap portion of the upper ring plate 11.

When the shuttle 20 slides along the raceway assembly 10, the inner guide rod units 14 can prevent removal of the shuttle 20 from the raceway assembly 10. Accordingly, the circular loom can weave a cloth of greater strength than the conventional circular loom. Without the wheels mounted on the shuttle 20, the warp threads (S) can not be cut off when the shuttle 20 slides along the raceway assembly 10. Accordingly, the circular loom can weave a cloth of weaker strength than the conventional circular loom.

Figure 10:
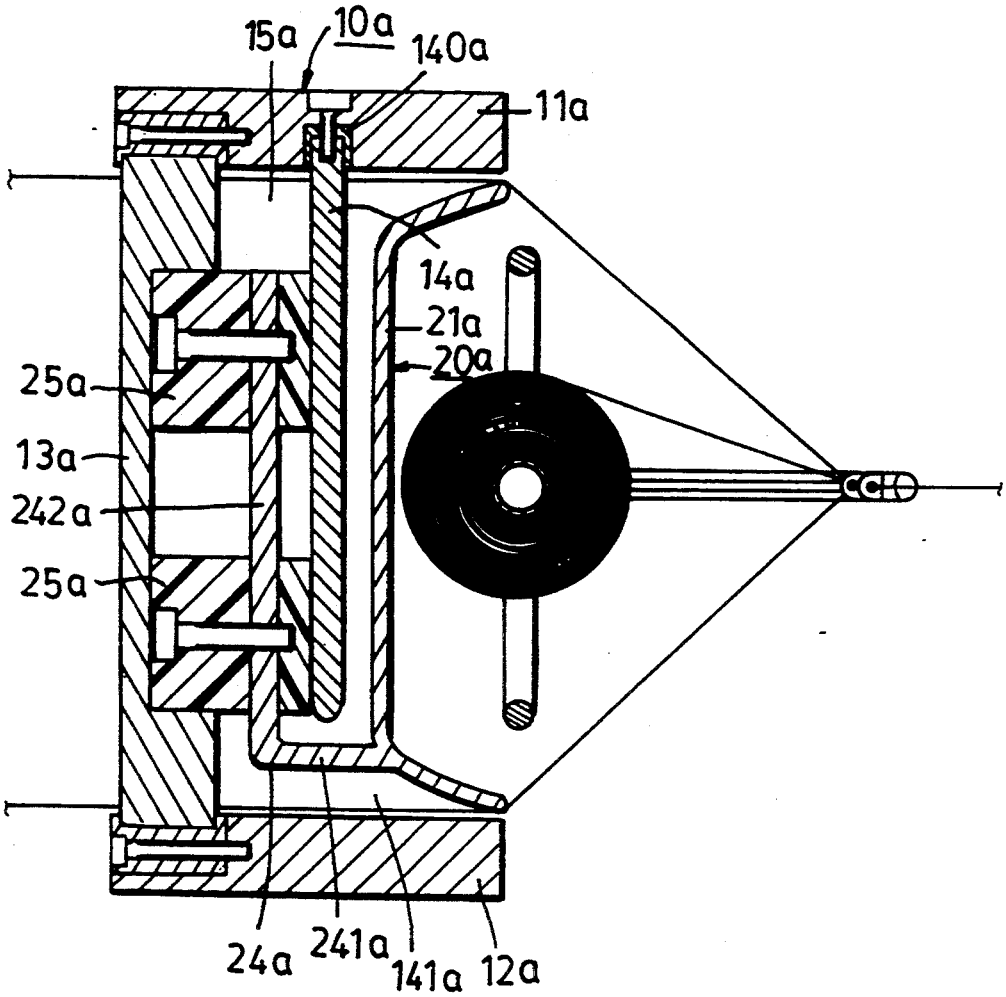
FIG. 10 is a sectional view showing an assembly of the raceway assembly and the shuttle of the circular loom according to the second embodiment of this invention.

FIG. 10 shows the modified inner guide rod units (14*a*) and guide plate assembly (24*a*) according to the second embodiment of this invention. As shown, each of the inner guide rod units (14*a*) has a single vertical inner rod section which has an upper end that is secured to an inner curved block (140*a*) which is mounted threadably on the upper ring plate (11*a*). The outer guide rod units (13*a*) and the inner guide rod units (14*a*) together define a confining space (15*a*). The single vertical inner rod section of each of the inner guide rod units (14*a*) and the lower ring plate (12*a*) define an accommodating space (141*a*) therebetween. The accommodating spaces (141*a*) of the inner guide rod units (14*a*) are aligned with each other. The guide plate assembly (24*a*) of the shuttle (20*a*) includes a horizontal guide plate (241*a*) which projects radially outward from the shuttle shell (21*a*) through the accommodating spaces (141*a*), and a vertical guide plate (242*a*) which has a lower end secured to a distal outer end of the horizontal guide plate (241*a*) and an upper end located at a level above the lower ends of the vertical inner rod sections of the inner guide units (14*a*). Two sliding bodies (25*a*) are connected respectively and removably to the upper and lower portions of the vertical guide plate (242*a*) and are confined in the confining space (15*a*) so as to allow the shuttle (20*a*) to slide along the raceway assembly (10*a*).

Figure 11:
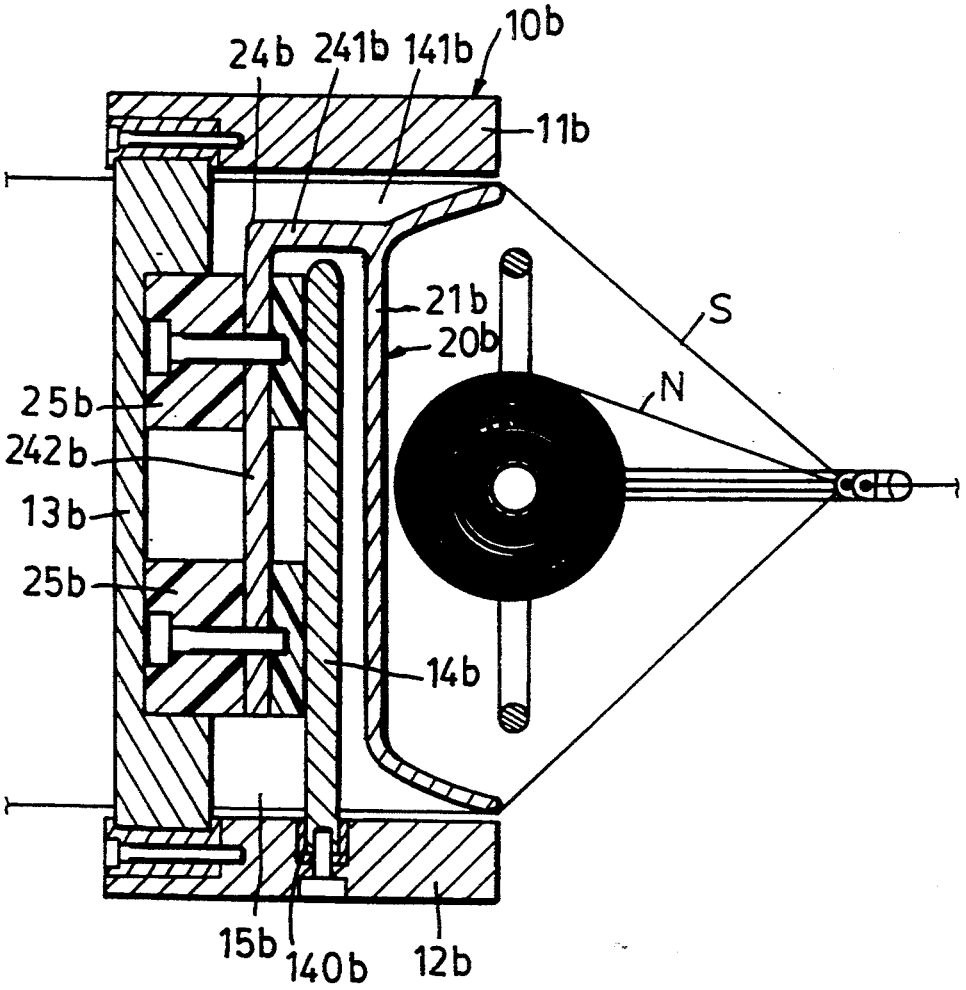
FIG. 11 is a sectional view showing an assembly of the raceway assembly and the shuttle of the circular loom according to the third embodiment of this invention.
Figure 12:
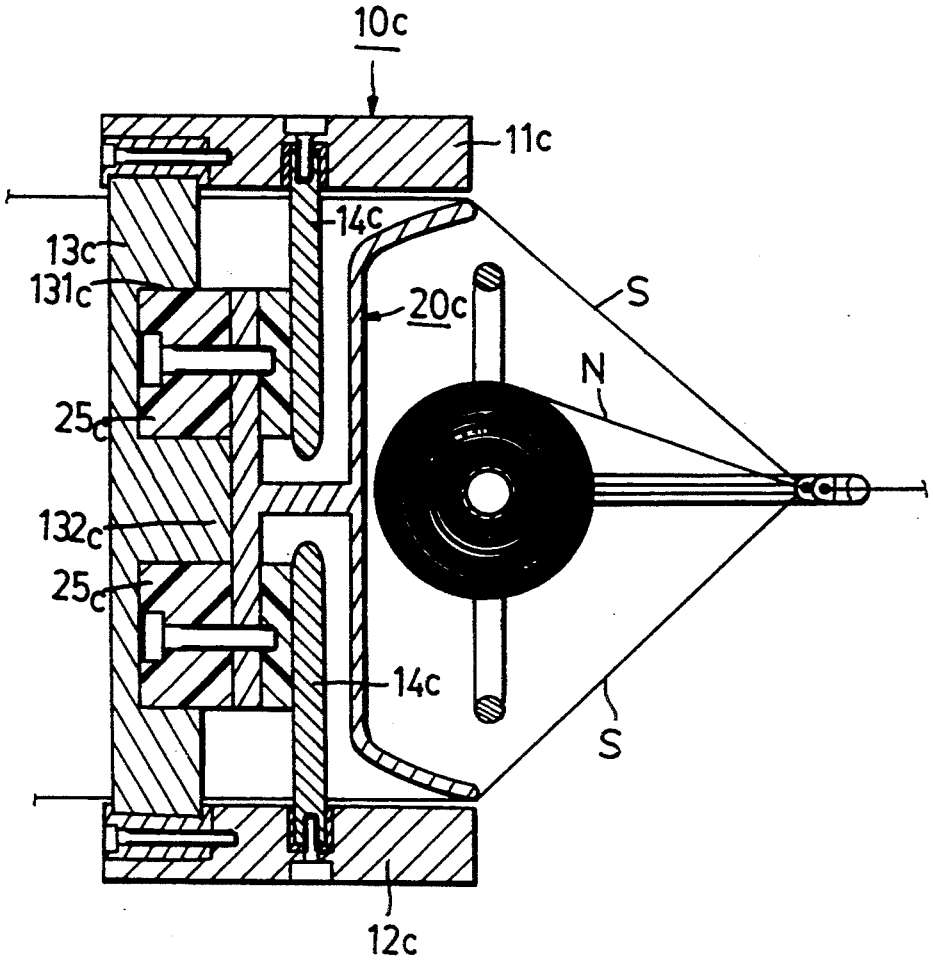
FIG. 12 is a sectional view showing an assembly of the raceway assembly and the shuttle of the circular loom according to the fourth embodiment of this invention.

FIG. 11 shows the modified inner guide rod units (14*b*) and guide plate assembly (24*b*) according to the third embodiment of this invention. As shown, each of the inner guide rod units (14*b*) has a single vertical inner rod section with a lower end that is secured to an inner curved block (140*b*) which is mounted threadably on the lower ring plate (12*b*). The outer guide rod units (13*b*) and the inner guide rod units (14*b*) together define a confining space (15*b*). The single vertical inner rod section of each of the inner guide rod units (14*b*) and the upper ring plate (11*b*) define an accommodating space (141*b*) therebetween. The accommodating spaces (141*b*) of the inner guide rod units (14*b*) are aligned with each other. The guide plate assembly (24*b*) of the shuttle (20*b*) includes a horizontal guide plate (241*b*) which projects radially outward from the shuttle shell (21*b*) through the accommodating spaces (141*b*), and a vertical guide plate (242*b*) which has an upper end secured to a distal outer end of the horizontal guide plate (241*b*) and a lower end located at a level below the upper ends of the vertical inner rod sections of the inner guide units (14*b*). Two sliding bodies (25*b*) are connected respectively and removably to the upper and lower portions of the vertical guide plate (242*b*) and are confined in the confining space (15*b*) so as to allow the shuttle (20*b*) to slide along the raceway assembly FIG. 12 shows the modified outer guide rod units (13*c*) according to the fourth embodiment of this invention. As shown, the endless raceway assembly (10*c*) and the shuttles (20*c*) (only one is shown) are similar in construction to the first embodiment of this invention except for the outer guide rod units (13*c*). Each of the outer guide rod units (13*c*) has a generally vertical continuous outer rod section which interconnects securely the upper and lower ring plates (11*c*), (12*c*) in the same manner as that of the first embodiment, a recess (131*c*) which is formed in a surface of the outer rod section and which faces a corresponding one of the inner guide rod units (14*c*), and a positioning block (132*c*) which is mounted securely in the recess (131*c*) and which is located between the sliding bodies (25*c*) when the shuttle (20*c*) slides over the outer guide rod units (13*c*). Accordingly, the positioning blocks (132*c*) can effectively confine the sliding bodies (25*c*) within the recesses (131*c*) of the outer guide rod units (13*c*).

Figure 13:
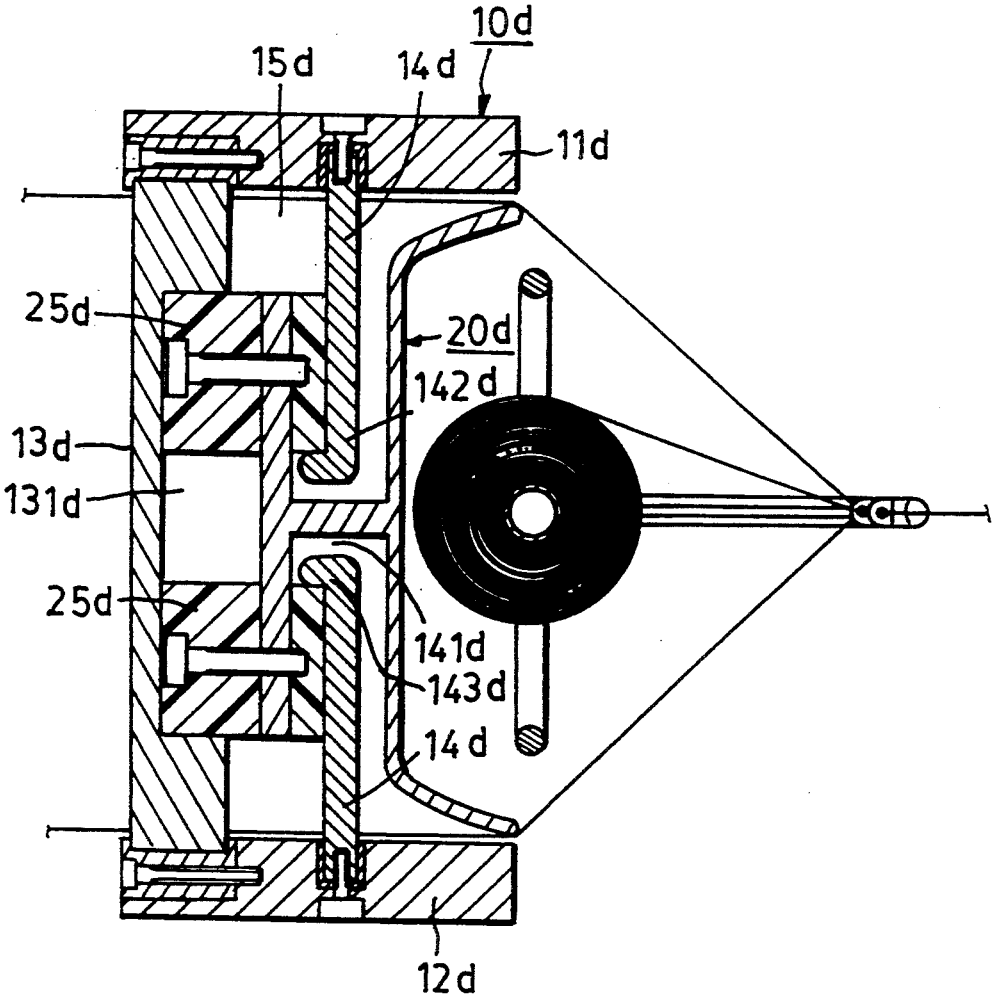
FIG. 13 is a sectional view showing an assembly of the raceway assembly and the shuttle of the circular loom according to the fifth embodiment of this invention.

FIG. 13 shows the modified inner guide rod units (14*d*) according to the fifth embodiment of this invention. As shown, the endless raceway assembly (10*d*) and the shuttles (20*d*) are similar in construction to the first embodiment of this invention except for the inner guide rod units (14*d*). Each of the inner guide rod units (14*d*) has an upper inner rod section and a lower inner rod section which are respectively secured to the upper and lower ring plates (11*d*), (12*d*) in the same manner as that of the first embodiment so as to define one of the accommodating spaces (141*d*) between the upper and lower inner rod sections. The upper inner rod section of each of the inner guide rod units (14*d*) has an L-shaped lower end portion (142*d*) which includes a vertical section mounted securely on a remaining portion of the upper inner rod section, and a horizontal section that has a radial inner end mounted securely on the lower end of the vertical section of the L-shaped lower end portion (142*d*). Accordingly, the L-shaped lower end portion (142*d*) can retain the upper sliding body (25*d*) within the confining space (15*d*) so as to allow the upper sliding body (25*d*) to effectively slide within the recesses (131*d*) of the outer guide rod units (13*d*). The lower inner rod section of each of the inner guide rod units (14*d*) has an L-shaped upper end portion (143*d*) which includes a vertical section that is mounted securely on a remaining portion of the lower inner rod section, and a horizontal section having a radial inner end that is mounted securely on the upper end of the vertical section of the L-shaped upper end portion (143*d*). Accordingly, the L-shaped upper end portion (143*d*) can retain the lower sliding body (25*d*) within the confining space (15*d*) so as to allow the upper sliding body (25*d*) to effectively slide within the recesses (131*d*) of the outer guide rod units (13*d*).

With this invention thus explained, it is apparent that numerous modifications and variations can be made without departing from the scope and spirit of this invention. It is therefore intended that this invention be limited only as indicated in the appended claims.

I claim:

1. A circular loom including an endless raceway assembly and a shuttle sliding along the raceway assembly, the raceway assembly including a stationary horizontal upper ring plate, a stationary horizontal lower ring plate located under the upper ring plate, and a vertical rod mechanism interposed between the upper and lower ring plates, wherein the improvement comprises:

the rod mechanism including a row of circumferentially aligned outer guide rod units spaced apart from each other at a first predetermined distance, and a row of circumferentially aligned inner guide rod units spaced apart from each other at a second predetermined distance and located inside the outer guide rod units, each of the inner guide rod units being radially aligned with a corresponding one of the outer guide rod units so as to define a confining space between the inner guide rod unit and the corresponding one of the outer guide rod units, the inner and outer guide rod units being radially spaced apart from each other at a third predetermined distance, each of the outer guide rod units having a generally vertical continuous outer rod section interconnecting securely the upper and lower ring plates, each of the inner guide rod units including at least one generally vertical continuous inner rod section positioned between the upper and lower ring plates, and an accommodating space positioned between the upper and lower ring plates and in line with the inner rod section, the shuttle including a shuttle body, a horizontal guide plate secured to and extending radially outward from the shuttle body, a tangentially extending vertical guide plate connected securely to a radial outer end of the horizontal guide plate, and two sliding bodies connected respectively and removably to upper and lower portions of the vertical guide plate, the horizontal guide plate extending through the accommodating spaces of the inner guide rod units when the shuttle slides along the raceway assembly, the vertical guide plate being confined between the inner and outer guide rod units, each of the sliding bodies having two vertical side walls which respectively slide on the inner and outer guide rod units, one of the upper and lower ring plates having a removable portion which is connected removably to a remaining portion thereof and which is coupled with some of the inner guide rod units so as to locate the vertical guide plate of the shuttle into several of the confining spaces.

2. A circular loom as claimed in claim 1, wherein each of the outer guide rod units has a recess which is formed in a surface thereof and which faces a corresponding one of the inner guide rod units so as to receive slidably the sliding bodies of the shuttle therein.

3. A circular loom as claimed in claim 2, wherein each of the outer guide rod units includes a positioning block which is secured in the recess and which is located between the sliding bodies when the shuttle slides over the outer guide rod units.

4. A circular loom as claimed in claim 1, wherein each of the inner guide rod units has an upper inner rod section with an upper end secured to the upper ring plate, and a lower inner rod section with a lower end secured to the lower ring plate, one of the accommodating spaces being defined between the upper inner rod section and the lower inner rod section, the vertical guide plate of the shuttle having a middle portion which is coupled with the horizontal guide plate and which is located between the upper and lower portions of the vertical guide plate, an upper end located at a level above lower ends of the upper inner rod sections, and a lower end located at a level below upper ends of the lower inner rod sections.

5. A circular loom as claimed in claim 4, wherein the upper inner rod section of each of the inner guide rod units has an L-shaped lower end portion which includes a vertical section secured to a remaining portion of the upper inner rod section, and a horizontal section having a radial inner end secured to a lower end of the vertical section of the L-shaped lower end portion, the lower inner rod section of each of the inner guide rod units having an L-shaped upper end portion which includes a vertical section secured to a remaining portion of the lower inner rod section, and a horizontal section having a radial inner end secured to an upper end of the vertical section of the L-shaped upper end portion.

6. A circular loom as claimed in claim 1, wherein each of the inner guide rod units has a single vertical inner rod section with an upper end secured to the upper ring plate, the single vertical inner rod section of each of the inner guide rod units and the lower ring plate defining one of the accommodating spaces therebetween, the vertical guide plate of the shuttle having a lower end secured to the horizontal guide plate and an upper end located at a level above lower ends of the vertical inner rod sections of the inner guide rod units.

7. A circular loom as claimed in claim 1, wherein each of the inner guide rod units has a single vertical inner rod section with a lower end secured to the lower ring plate, the single vertical inner rod section of each of the inner guide rod units and the upper ring plate defining one of the accommodating spaces therebetween, the vertical guide plate of the shuttle having an upper end secured to the horizontal guide plate and a lower end located at a level below upper ends of the vertical inner rod sections of the inner guide rod units.

* * * * *